US008494391B2

(12) United States Patent
Ishii

(10) Patent No.: US 8,494,391 B2
(45) Date of Patent: Jul. 23, 2013

(54) IMAGE FORMING APPARATUS HAVING A JOB INTERRUPTION CONTROL UNIT

(75) Inventor: Hiroki Ishii, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 296 days.

(21) Appl. No.: 12/929,278

(22) Filed: Jan. 12, 2011

(65) Prior Publication Data

US 2011/0182596 A1 Jul. 28, 2011

(30) Foreign Application Priority Data

Jan. 25, 2010 (JP) ..... 2010-012964

(51) Int. Cl.
*G03G 15/00* (2006.01)
*G03G 21/00* (2006.01)

(52) U.S. Cl.
USPC ..... 399/71; 399/34

(58) Field of Classification Search
USPC ..... 399/71, 34, 44
See application file for complete search history.

(56) References Cited

U.S. PATENT DOCUMENTS

2004/0170442 A1* 9/2004 Forbes et al. ..... 399/27
2009/0016762 A1* 1/2009 Ota ..... 399/74

FOREIGN PATENT DOCUMENTS

JP 3804471 A 12/2002
JP 4554336 A 6/2006
JP 2006235563 A 9/2006

OTHER PUBLICATIONS

Abstract of JP 2006-139111 published on Jun. 1, 2006.
Abstract of JP 2002-372902 published on Dec. 26, 2002.

* cited by examiner

*Primary Examiner* — G. M. Hyder
(74) *Attorney, Agent, or Firm* — Harness, Dickey & Pierce, P.L.C.

(57) ABSTRACT

If an input of a continuous image forming job is received, a time for interrupting the continuous image forming job is decided based on an image area ratio of a toner image that is formed on a latent image carrier through the continuous image forming job and a predetermined number of formed images (the number of passed sheets) that is formed until a predetermined type of abnormal image is generated when continuous image formation is performed at the image area ratio. During an interruption period of the continuous image forming job, an idle rotation in which the latent image carrier rotates in a state in which the toner is not supplied to the latent image carrier by the developing unit is performed, and the cleaning process is performed.

7 Claims, 5 Drawing Sheets

IMAGE FORMING APPARATUS HAVING A JOB INTERRUPTION CONTROL UNIT

CROSS-REFERENCE TO RELATED APPLICATIONS

The present application claims priority to and incorporates by reference the entire contents of Japanese Patent Application No. 2010-012964 filed in Japan on Jan. 25, 2010.

BACKGROUND OF THE INVENTION

1. Field of the Invention

The present invention relates to an image forming apparatus such as a copying machine, a printer, and a facsimile, and more particularly, to an image forming apparatus in which a toner image obtained by developing a latent image on a latent image carrier is transferred onto a recording material and a process of cleaning the latent image carrier is performed.

2. Description of the Related Art

It has been known that it is difficult to appropriately perform cleaning by a well-known blade cleaning technique in the case of using a spherical toner having a small particle diameter. The reason is as follows. In the blade cleaning technique, as the latent image carrier is rotationally driven, the blade removes the toner while rubbing the surface of the latent image carrier. For this reason, an abutting edge portion of the cleaning blade is deformed due to the frictional resistance between the cleaning blade and the latent image carrier, and a tiny space is formed between the latent image carrier and the blade. The toner having a small particle diameter can easily intrude into the space. As the shape of the toner that introduced into the space is more spherical, rolling frictional force decreases, and the toner easily rolls into in the space between the latent image carrier and the cleaning blade and is likely to escape from the cleaning blade. Thus, in the case of using the spherical toner having a small particle diameter, a large amount of the toner escapes from the cleaning blade. The toner that has escaped from the cleaning blade is not removed from the latent image carrier and continuously stays on the surface of the latent image carrier, causing a so-called filming phenomenon that the toner is fixed on the surface of the latent image carrier in a film state due to the action of a release agent or a fluidizer contained in the toner. The filming phenomenon produces a void in a solid portion of an image, that is, an abnormal image is produced.

From the past, there is known an image forming apparatus in which the surface of the latent image carrier is coated with a lubricant made of a metal salt of a fatty acid to improve a cleaning property of the latent image carrier and thereby to prevent filming when using the toner having a small particle diameter (see Japanese Patent Application Laid-open No. 2006-235563). According to the image forming apparatus, by forming a thin film on the surface of the latent image carrier with a lubricant, a frictional coefficient between the toner and the surface of the latent image carrier is reduced, so that the cleaning property of the cleaning blade improves.

However, even the image forming apparatus in which the surface of the latent image carrier is coated with the lubricant still has a problem in that an abnormal image is produced due to the filming.

FIG. 9 is an explanation view illustrating an example of an abnormal image that is generated when a release agent or a fluidizer contained in the toner adheres to the surface of the latent image carrier and thus filming occurs.

The abnormal image is an image in which a killifish-shaped void is formed in a solid portion of an image. The void appears with a frequency corresponding to the circumferential length of the latent image carrier. The inventors of the present application have investigated it and found that the abnormal image is likely to be formed when an image is formed under the following two conditions.

First, it generates under the condition in which images with a high image area ratio are continuously produced.

When forming an image with a high image area ratio, a large amount of residual transfer toner is generated and a large amount of toner escapes from the cleaning blade. As a result, a large amount of toner intrudes into a lubricant coating brush. If such state is continuous, the toner may become solidified in the lubricant coating brush. In the case of using a process in which a powder lubricant scraped from a solid lubricant is coated by the lubricant coating brush, a large amount of toner that has intruded into and thus exists in the lubricant coating brush is also mixed with the solid lubricant, so that the toner may become solidified by the solid lubricant. If this happens once, the lubricant cannot be uniformly and stably coated. Accordingly, portions having the high frictional coefficient are locally formed on the surface of the latent image carrier. A substance that causes filming easily adheres to the portions. As a result, the filming occurs and an abnormal image is produced as illustrated in FIG. 9.

The second condition is the case in which images with a low image area ratio are continuously produced.

When forming an image with a low image area ratio, the amount of residual transfer toner is small. Accordingly, a small amount of toner escapes from the cleaning blade. The small amount of toner intrudes into the lubricant coating brush. If the small amount of toner has intruded into the lubricant coating brush, in the case of coating the powder lubricant scraped from the solid lubricant with the use of the lubricant coating brush, it is known that the amount of the lubricant scraped by the lubricant coating brush is small. Generally, since an amount of the lubricant supplied from the lubricant coating brush is not uniform, if the amount of the lubricant scraped by the lubricant coating brush decreases and the supply amount of lubricant from the lubricant coating brush decreases, there may be a portion with an insufficient amount lubricant, on the surface of the latent image carrier. The portion increases in frictional coefficient. Thus, in the case of continuously forming the images with a low image area ratio, a portion having the high frictional coefficient is formed on the surface of the latent image carrier, and a substance that causes filming easily adheres to the portion. Thus, filming occurs, so that the abnormal image is produced as illustrated in FIG. 9.

The above problem may not be limitedly involved in the blade cleaning technique of using a cleaning blade as a cleaning member but be involved in all cleaning techniques of performing cleaning based on rubbing the latent image carrier using a cleaning brush or other cleaning members.

The present invention is made in view of the above mentioned problems, and it is an object of the present invention to provide an image forming apparatus capable of preventing production of an abnormal image when forming an image even under the condition in which an abnormal image with a killifish-shaped void in a solid image portion is likely to be formed.

According to the present invention, during the continuous image forming job, the job is interrupted. During the interruption period, the latent image carrier idly rotates, and the cleaning process of rubbing with the cleaning member is performed. The idle rotation of the latent image carrier is referred to as a rotation of the latent image carrier in a state in which the toner is not supplied to the latent image carrier from the developing unit. Thus, during the idle rotation of the latent image carrier, nearly no toner is present on the latent image carrier. In this state, frictional force of the cleaning member on the latent image carrier is improved compared with the state in which the toner is supplied to the latent image carrier. As a result, the substance that is the cause of filming and is not able to be removed from the latent image carrier during image formation can be removed by rubbing of the cleaning member. Therefore, according to the present invention, the material causing the filming that has grown on the latent image carrier until interruption due to continuous image formation during the continuous image forming job can be removed, and the surface state related to filming on the latent image carrier can be reset.

Here, if the cleaning process is performed, frequently interrupting the continuous image forming to prevent production of an abnormal image in which a killifish-shaped void is formed in a solid portion of an image (hereinafter, referred to as simply "abnormal image with a void") during the continuous image forming job, the productivity of the image deteriorates. Thus, the interruption frequency during the continuous image forming job is preferably as low as possible.

As a result of keen study described in detail later, the inventors of the present invention has found out that the time at which the abnormal image with a void is generated during the continuous image forming job can be specified with high accuracy based on the image area ratio of the toner image that is formed on the latent image carrier by the continuous image forming job and a given number of formed images where a predetermined number of abnormal images is generated when continuous image formation is performed with the image area ratio.

Therefore, according to the present invention, directly before the time at which the abnormal image with a void is generated through continuous image forming job, the job is interrupted, and the cleaning process is performed, thereby preventing the generation of the abnormal image with a void. As a result, the interruption frequency during the continuous image forming job can be reduced to a level as low as possible, thereby preventing the productivity decline.

SUMMARY OF THE INVENTION

It is an object of the present invention to at least partially solve the problems in the conventional technology.

There is provided an image forming apparatus that develops a latent image on a rotationally driven latent image carrier by a developing unit using a toner when receiving an input of an image forming job, transfers a toner image thus obtained onto a recording material, and performs a cleaning process of removing an unnecessary substance adhering to the latent image carrier by rubbing the rotationally driven latent image carrier by a cleaning member, the image forming apparatus comprising: a job interruption control unit that, when an input of a continuous image forming job for continuously forming an image on a plurality of recording materials is received, decides timing for interrupting the continuous image forming job based on an image area ratio of a toner image formed on the latent image carrier through the continuous image forming job and a predetermined number of formed images that is formed until a predetermined type of abnormal image is generated when the continuous image formation is performed with the image area ratio; and during an interruption period of the continuous image forming job, performs an idle rotation in which the latent image carrier rotates in a state in which the toner is not supplied to the latent image carrier by the developing unit to perform the cleaning process.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an exemplary embodiment of an electronic photographic printer as an image forming apparatus to which the invention is applied will be explained.

First, the basic structure of a printer according to the present exemplary embodiment will be explained.

Figure 1:
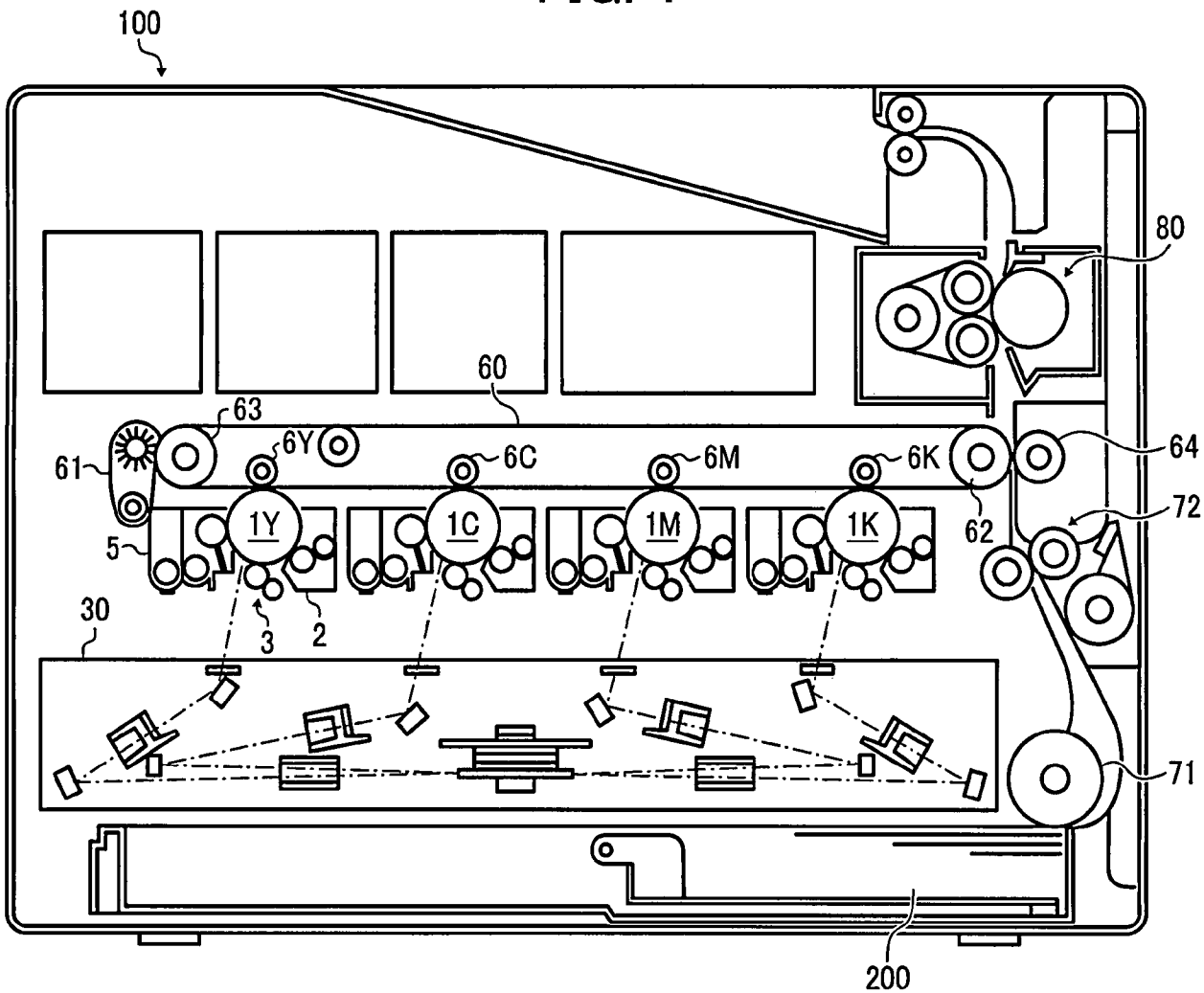
FIG. 1 is a schematic diagram illustrating the structure of a printer according to an exemplary embodiment.

FIG. 1 is a schematic view illustrating the structure of a printer according to the present exemplary embodiment.

Referring to FIG. 1, a printer 100 includes four process units for yellow, cyan, magenta, and black (hereinafter, referred to as "Y, C, M, and K"). The process units use toners of different colors of Y, C, M, and K, respectively, as image forming substances for forming an image but have the similar structure in terms of other components. The process units include photoreceptor drums 1Y, 1C, 1M, and 1K, respectively, serving as latent image carriers. The respective process units are configured in a manner such that the photoreceptor drums 1Y, 1C, 1M, and 1K and members disposed around them are integrally attached to and detached from a printer body.

Figure 2:
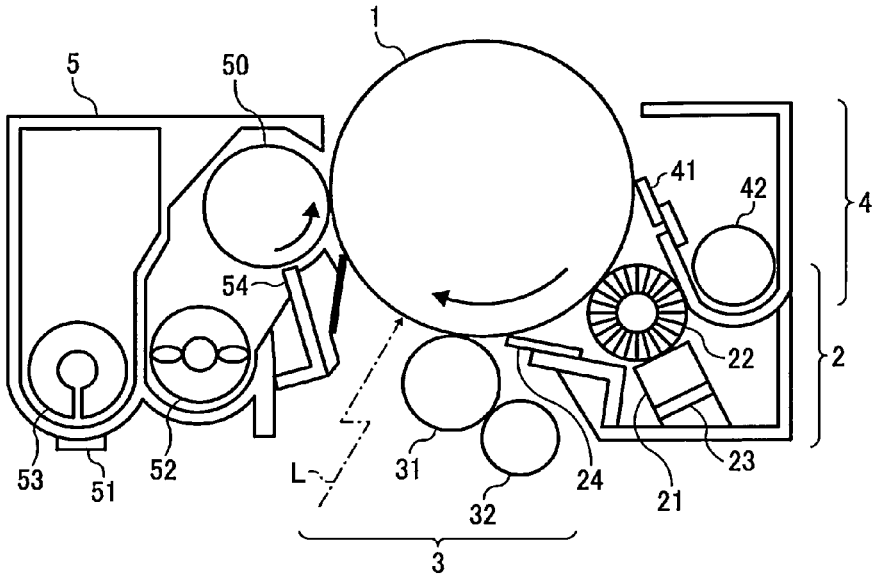
FIG. 2 is an explanatory view illustrating the schematic structure of a process unit of the printer.

FIG. 2 is an explanatory view illustrating the schematic structure of the process unit.

Around the photoreceptor drum 1, disposed are a drum cleaning apparatus 4 as a cleaning unit for removing and collecting the residual transfer toner adhering to the surface of the photoreceptor drum 1, a lubricant coating apparatus 2 as a lubricant coating unit for coating a powder lubricant on the surface of the photoreceptor drum 1 to adjust a surface frictional coefficient of the photoreceptor drum 1 to a predetermined value, a charging apparatus 3 for uniformly charging the surface of the photoreceptor drum 1, and a developing apparatus 5 for developing the latent image formed on the surface of the photoreceptor drum 1 with the use of the toner.

The drum cleaning apparatus 4 employs a blade cleaning system for rubbing and cleaning the surface of the photoreceptor drum 1 with a cleaning blade 41 serving as a cleaning member but is not limited thereto. A cleaning system of rubbing and cleaning the surface of the photoreceptor drum 1 using any other cleaning member such as a cleaning brush may be employed. The drum cleaning apparatus 4 according to the present exemplary embodiment rubs the surface of the photoreceptor drum 1 with the cleaning blade 41 and collects the residual transfer toner from the surface of the photoreceptor drum 1 so as to be stored in the drum cleaning apparatus 4. The collected residual transfer toner is conveyed to a waste toner bottle disposed outside the drum cleaning apparatus 4 by a waste toner conveying member 42.

The lubricant coating apparatus 2 includes a solid lubricant made of zinc stearate, a lubricant coating brush 22 that is rotationally driven in a state of abutting on the solid lubricant 21 and the photoreceptor drum 1, a spring 23 that biases the solid lubricant 21 in a direction of abutting on the lubricant coating brush 22, and a lubricant leveling blade 24 that levels the lubricant coated on the photoreceptor drum by the lubricant coating brush 22. The lubricant coating apparatus 2 scrapes the powder lubricant from the solid lubricant 21 with the lubricant coating brush 22 that is rotationally driven when coating the powder lubricant on the surface of the photoreceptor drum 1.

The charging apparatus 3 is disposed in a manner such that a charging roller 31 is in contact with or is at a close distance from the surface of the photoreceptor drum, but any other charging apparatuses such as a corona charger using a charging wire such as a so-called corotron or scorotron may be used. A charging bias in which a direct current (DC) voltage is superimposed on an alternating current (AC) voltage is applied to the charging roller 31 from a charging bias applying unit (not shown). A cleaning roller 32 for removing the toner adhering to the charging roller 31 is disposed inside the charging apparatus 3. The toner on the charging roller 31 is electrostatically removed by the cleaning roller 32.

The developing apparatus 5 includes a first developer storage unit in which a first conveying screw 53 is disposed and a second storage unit in which a second conveying screw 53 is disposed. A toner concentration sensor 51 such as a magnetic permeability sensor is disposed on a lower surface of the first developer storage. Since a mixing ratio of a toner and a carrier that is a magnetic material can be calculated based on the magnetic permeability obtained from the sensing result of the toner concentration sensor 51, the toner concentration of the developer can be calculated. The toner is supplied from the toner feeding apparatus (not shown) if necessary so that the toner concentration in the developer becomes a desired toner concentration. As the first conveying screw 53 is rotationally driven by a drive unit (not shown), the developer in the first developer storage unit is conveyed from the back side to the front side in a direction orthogonal to the paper plane of the drawing. The developer enters the second developer storage unit via a communication port (not shown) formed in a partition wall between the first developer storage unit and the second developer storage unit. The second conveying screw 52 in the second developer storage unit is rotationally driven by a drive unit (not shown), and the developer is conveyed from the front side to the back side. A developing sleeve 50 serving as a developer carrier is disposed above the second conveying screw 52 in parallel with the second conveying screw 52. The developing sleeve 50 is rotationally driven counterclockwise in the drawing. The developing sleeve 50 is made of a non-magnetic material such as aluminum, and the surface thereof is roughened by sandblasting. A magnet (not shown) is fixed to the inside of the developing sleeve 50. A part of the developer conveyed by the second conveying screw 52 is pumped to the surface of the developing sleeve 50 by magnetic force generated by the magnet. The layer thickness is regulated by a doctor blade 54 disposed with a predetermined gap from the developing sleeve 50. Thereafter, the developer is conveyed up to a developing area facing the photoreceptor drum 1. A developing bias is applied to the developing sleeve 50 from a developing bias applying unit (not shown), so that the toner comes to adhere to the latent image formed on the photoreceptor drum 1 to form a toner image. The developer that has expended its toner therein during the developing returns onto the second conveying screw 52 by rotational motion of the developing sleeve 50. When the developer is conveyed up to the back end in the drawing, the developer returns to and is collected in the first developer storage unit via the communication port (not shown).

The result of sensing the magnetic permeability of the developer by the toner concentration sensor 51 is transmitted to a control unit (not shown) as a voltage signal. Since the magnetic permeability of the developer represents a correlation between the developer and the toner concentration, the toner concentration sensor 51 outputs a voltage having a value depending on the toner concentration. The control unit includes an information storage unit such as a random access memory (RAM) that stores a target value Vref of the output voltage from the toner concentration sensor. The target value Vref is compared with the output voltage value from the toner concentration sensor. The toner is supplied from the toner feeding apparatus (not shown) to the back side of the first developer storage unit in the drawing in an amount corresponding to the comparison result, so that the toner concentration of the developer is maintained to a desired value. Toner feeding control is performed for each color by the toner concentration sensor 51 and the toner feeding apparatus.

An exposure unit 30 is disposed below the four process units serving as a latent image forming unit in the drawing. The exposure unit 30 irradiates laser light L onto the surface of the photoreceptor drum 1 of each process unit based on image information. As a result, the latent image is formed on the surface of the photoreceptor drum 1. Further, the exposure unit 30 scans with laser light emitted from a laser diode that is a light source with the use of a polygon mirror that is rotationally driven by a motor to irradiate the laser light onto the surface of the photoreceptor drum using a plurality of optical lenses or mirrors. Instead of this configuration, a configuration utilizing an LED array may be employed.

A sheet feed cassette 200 is disposed below the exposure unit 30. Recording sheet as a recording material is accommodated in the sheet feed cassette 200, and the top recording sheet abuts on a sheet feed roller 71. If the sheet feed roller 71 is rotationally driven counterclockwise at predetermined timing by the drive unit (not shown), the recording sheet is discharged toward a sheet feed path disposed to extend from the right side of the cassette in a vertical direction in the drawing. The recording sheet that has sent to the sheet feed path is conveyed upward so that it comes to arrive at a resist roller pair 72, and then stops. In synchronization with timing at which the toner image formed on an intermediate transfer belt 60 arrives at the secondary transfer nip, the resist roller pair 72 is driven at predetermined timing to feed the recording sheet toward the second transfer nip.

A transfer unit as a transfer portion for stretching and endlessly moving the intermediate transfer belt 60 as an intermediate transfer body that is an image carrier counterclockwise in the drawing is disposed above each process unit. The transfer unit includes a belt cleaning unit 61, primary transfer rollers 6Y, 6C, 6M, and 6K disposed at positions facing the photoreceptor drums of the respective colors, a driving roller 62 that is externally driven to drive the intermediate transfer belt, and a belt tension roller 63, in addition to the intermediate transfer belt 60. The driving roller 62 also acts as a facing roller of a secondary transfer roller 64. The intermediate transfer belt 60 is stretched over the rollers 6Y, 6C, 6M, 6K, 62, and 63 and endlessly moved counterclockwise in the drawing by the rotation drive of the driving roller 62.

The primary transfer rollers 6Y, 6C, 6M, and 6K abut on the photoreceptor drums 1Y, 1C, 1M, and 1K, with the intermediate transfer belt 60 interposed therebetween to form the primary transfer nip. A transfer bias having a polarity reverse to a normal charging polarity of the toner is applied to the primary transfer rollers 6Y, 6C, 6M, and 6K. The toner image on the photoreceptor drum is transferred onto the intermediate transfer belt 60 by the transfer bias. The toner images of the respective colors formed on the photoreceptor drums are sequentially primary-transferred onto the intermediate transfer belt 60 in a superimposed manner, so that the toner image is formed on the intermediate transfer belt.

The secondary transfer roller 64 is disposed outside the intermediate transfer belt 60 at a position facing the driving roller 62 with the intermediate transfer belt 60 interposed therebetween. The secondary transfer nip is formed by the secondary transfer roller 64 and the intermediate transfer belt 60. The toner image formed on the intermediate transfer belt 60 moves to the secondary transfer nip by the rotational drive of the intermediate transfer belt 60. At the same time, in synchronization with timing at which the toner image enters into the secondary transfer nip from the resist roller 72, the recording sheet enters the secondary transfer nip. The toner image is secondary-transferred onto the recording sheet by a secondary transfer electric field and nip pressure formed between the secondary transfer roller 64 and the driving roller 62. The secondary transfer electric field is formed by applying the transfer bias having the same polarity as the toner to the driving roller 62 and grounding the secondary transfer roller 64.

The residual transfer toner that is not transferred onto the recording sheet slightly remains on and adheres to the intermediate transfer belt 60 that passed through the secondary transfer nip. The residual transfer toner is cleaned by the belt cleaning unit 61. The belt cleaning unit 61 makes a cleaning blade abut on the surface of the intermediate transfer belt 60 and scrapes and removes the residual transfer toner on the intermediate transfer belt 60. The residual transfer toner that is removed from the intermediate transfer belt 60 is collected in the waste toner bottle and is discarded.

A fixing unit 80 is disposed above the secondary transfer nip. The fixing unit 80 includes a heating member including an electromagnetic induction heat generating layer and a pressing member that abuts on the heating member at predetermined pressure to form a fixing nip. The recording sheet that passed through the secondary transfer nip is separated from the intermediate transfer belt 60 and then sent to the inside of the fixing unit 80. The recording sheet is inserted into the fixing nip of the fixing unit 80, heated in the fixing nip by the heating member while being conveyed toward the upper side from the lower side in the drawing, and pressed in the fixing nip at the same time, so that the toner image is fixed to the recording sheet. The recording sheet that has been subjected to the fixing process is externally discharged by a sheet discharge roller pair and stacked on the top surface of the printer body.

The toner bottles of the respective colors that accommodate Y, C, M, and K toners, respectively, are disposed above the transfer unit. The toners of the respective colors accommodated in the toner bottles are appropriately supplied to the developing apparatuses of the process units of the respective colors. The toner bottles are detachably mounted on the printer body. If there is no remaining toner in the bottle, the toner bottle can be replaced.

Next, as a feature of the present invention, control for preventing an abnormal image with a void in which a killfish-shaped void is formed in a solid portion of an image due to filming from occurring during a continuous image forming job will be explained.

Specific numerical values described below are for Ricoh Imagio MPC 4500 and were derived, from experimental equipment using a polymerization toner containing microcrystalline wax. The numerical values do not limit control timing or control method of the image creating condition to which the present invention can be applied. That is, the specific numerical values described below are examples, and the specific numerical values change if a material or a diameter of the photoreceptor drum diameter, a structure of the cleaning member, and a type of the toner are different. The polymerization toner will be explained below in detail.

Figure 3:
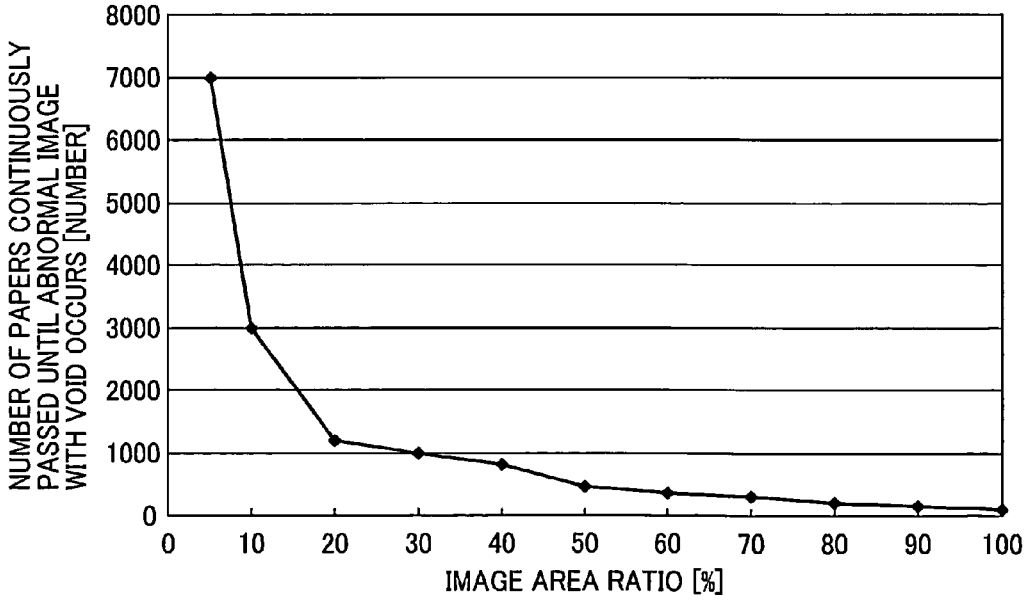
FIG. 3 is a graph illustrating the relationship between an image area ratio and the number of sheets that continuously passed until an abnormal image with a void is generated in the printer.

FIG. 3 is a graph illustrating the relationship between the image area ratio and the number of sheets continuously passed until the abnormal image with a void is produced by the printer according to the present exemplary embodiment.

As can be seen from the graph, as the image area ratio increases, the number of sheets that continuously has passed until an abnormal image with a void is produced decreases. That is, the higher the image area ratio is, the earlier the abnormal image with a void is produced.

In the case of forming an image having a low image area ratio equal to or less than 5%, the surface frictional coefficient of the photoreceptor drum 1 increases since the supply of the toner is insufficient. At this time, filming easily occurs, and the abnormal image with a void is easily generated. However, the printer 100 of the present exemplary embodiment forms the toner pattern between the images during continuous image formation for process control, and the supply of the toner corresponding to the image area ratio of minimum 5% is constantly performed. Therefore, the abnormal image with a void is not generated.

A time at which the abnormal image with a void is generated during continuous image formation can be specified from the graph illustrated in FIG. 3. That is, by grasping the image area ratio of the image formed by the continuous image forming job, the number of sheets that can continuously pass through without causing the abnormal image with a void can be specified. Therefore, according to the present exemplary embodiment, at timing before the number of sheets that has passed without generating the abnormal image with a void reaches the specified number, the continuous image forming job is interrupted. During the interruption period, the photoreceptor drum 1 is idly rotated and subjected to the cleaning process (hereinafter, referred to as "refresh process") by the cleaning apparatus 4. Specially, based on the correlation between the image area ratio and the number of sheets that can continuously pass through without causing the abnormal image with a void, the number being specified from the graph illustrated in FIG. 3, an interruption time of the continuous image forming job (a time directly before occurrence of the abnormal image with a void occurs) is specified, and the refresh process is performed by the cleaning apparatus 4 at the time of interruption.

According to the present exemplary embodiment, the interruption time of the continuous image forming job is specified using a void index value as follows. The void index value is referred to as a numerical value of a probability that the abnormal image will be generated in one piece of image (A4) having an image area ratio x(%) when a probability that the abnormal image with a void will occur in one piece of image (A4) having an image area ratio 100% is "1". The void index value of each image area ratio is computed as in Equation (1) below.

$$\text{Void index value} = 100(\%)/\text{the number of sheets that has continuously passed until an abnormal image with a void occurs} \quad (1)$$

The number of sheets that continuously passed until the abnormal image with a void occurs is referred to as the number of sheets that has passed until the abnormal image occurs (number) when continuous image formation is performed at the image area ratio, from the time at which the continuous image forming job starts, or the time of a previous interruption (previous refresh process), that is, from when filming does not occurs.

In the medium-temperature medium-humidity (MM) environment, a data table of Table 1 below reptesenting the relationship between the image area ratio and the void index value in the printer 100 of the present exemplary embodiment was obtained from the result of an experiment where the image area ratio varies at an interval of 10% and the printer 100 of the present exemplary embodiment was used.

TABLE 1

| Image area ratio [%] | Number of continuously passed sheets (number) | Void index value |
|---|---|---|
| <5 | 7000 | 0.0143 |
| 10 | 3000 | 0.0333 |
| 20 | 1200 | 0.0833 |
| 30 | 1000 | 0.1000 |
| 40 | 800 | 0.1250 |
| 50 | 450 | 0.2222 |
| 60 | 350 | 0.2857 |
| 70 | 300 | 0.3333 |
| 80 | 200 | 0.5000 |
| 90 | 160 | 0.6250 |
| 100 | 100 | 1.0000 |

Referring to Table 1, for example, when the void index value of one piece of image (A4) having the image area ratio 100% is 1.0, the void index value of one piece of image (A4) having the image area ratio 50% is 0.2222. if only the image area ratio is considered, the void index value of one piece of image (A4) having the image area ratio 50% should be 0.5, but the image having the image area ratio 50% is as twice as the image having the image area ratio 100% in the number of times that cleaning is performed during the image forming operation until the image having the image area ratio 100% and the image having the image area ratio 50% reach the same number of accumulated pixels. For this reason, the void index, value (the probability that the abnormal image with a void will occur) in the image having the image area ratio 50% is lower than half of that in the image having the image area ratio 100%.

According to the present exemplary embodiment, a category of the image area ratio in Table 1 corresponding to the image area ratio of each image performed by the continuous image forming job is judged during the job, and the void index value corresponding to the category is specified by the data table 1. The specified void index value is accumulated and counted, and the continuous image forming job is interrupted when the accumulated count value (the abnormal image occurrence index value) reaches 100. The idle rotation operation of the photoreceptor drum is performed during the interruption period. During the idle rotation operation, an operation of the cleaning apparatus 4 is typically performed, but the toner supply and the developing sleeve 50 stop, and the process of charging the photoreceptor drum through the charging apparatus 3 is not performed. As a result, during the idle rotation operation, the toner concentration of the developer or the toner charging amount does not change, and the photoreceptor drum can be prevented from degrading by the charging process. It was found that by performing the idle rotation operation, the probability that the abnormal image with a void will occur can be greatly reduced even at any image area ratio. This is because it was inferred that it was able to remove the substance causing filming on the photoreceptor drum 1, prevent filming in advance, and reset the filming state on the photoreceptor drum through the refresh process during the idle rotation operation. According to the present exemplary embodiment, the accumulated count value of the void index value is reset to 0 (zero) at the time of finishing the idle rotation operation.

Further, it was found that the effect of removing the substance causing filming by the refresh process during the idle rotation operation of the photoreceptor drum 1 is higher in the case of using the toner containing microcrystalline wax made by a SPR method than in the case of using any other toner. Even in the case of using any other toner, the effect of removing the substance causing filming can be increased by increasing the idle rotation operation time of the photoreceptor drum 1. However, in this case, since the photoreceptor surface is excessively damaged by the cleaning blade 41, a few toners may need to be input during the idle rotation operation.

Here, the time period in which the photoreceptor drum 1 idly rotates during the interruption period of the continuous image forming job may be a previously determined time period. However, according to the present exemplary embodiment, the idle rotation time changes depending on the accumulated travel distance of the photoreceptor drum (the accumulated travel distance from the initial point in time). The reasons will be explained below.

Figure 4:
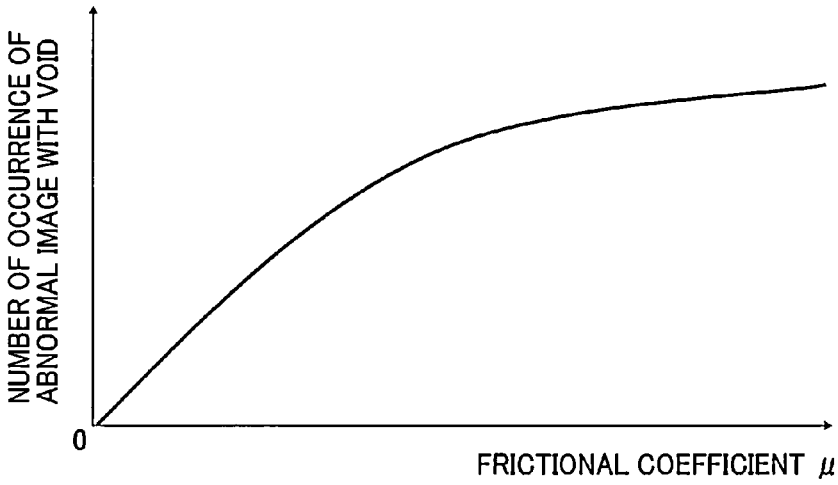
FIG. 4 is a graph illustrating the relationship between surface frictional coefficient of a photoreceptor drum and the number of occurrences of an abnormal image with a void.

FIG. 4 is a graph illustrating the relationship between the surface frictional coefficient of the photoreceptor drum 1 and the number of occurrence of the abnormal image with a void.

If the surface frictional coefficient of the photoreceptor drum 1 increases, the main substance that causes filming is easily adhered as described above. Thus, filming easily occurs, and so the abnormal image with a void easily occurs. Generally, the surface of the photoreceptor drum wears at each time when the image creating operation is performed, and the surface frictional coefficient tends to increase. For this reason, as the accumulated travel distance of the photoreceptor drum increases, the number of occurrence of the abnormal image with a void increases.

Figure 5:
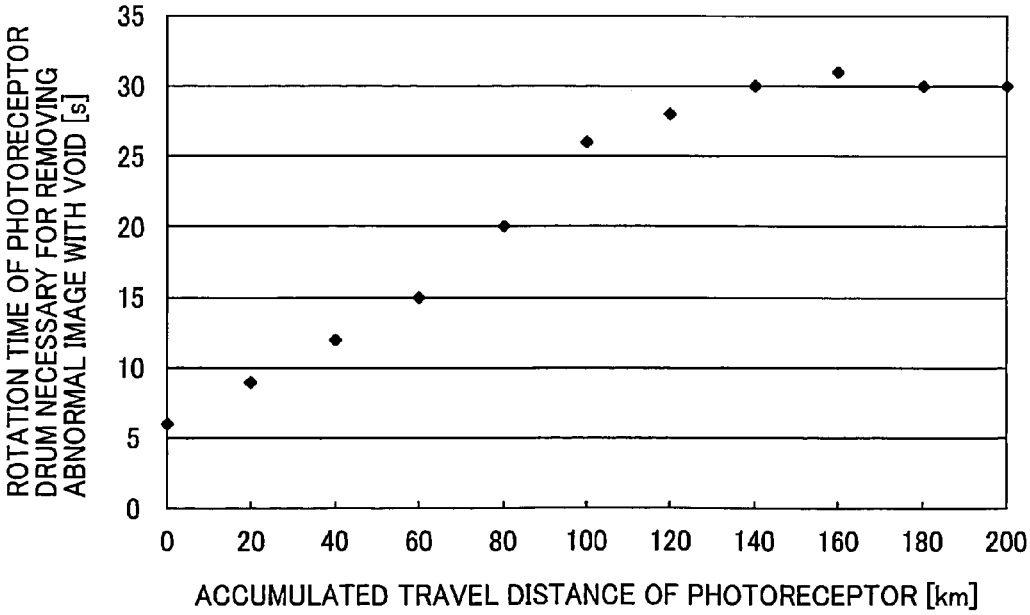
FIG. 5 is a graph illustrating the relationship between an accumulated travel distance of the photoreceptor drum and an idle rotation time of the photoreceptor drum required to eliminate an occurrence of the abnormal image with a void in the printer.

FIG. 5 is a graph illustrating a relationship between the accumulated travel distance of the photoreceptor drum 1 and the idle rotation time of the photoreceptor drum necessary for removing the abnormal image with a void in the printer 100 of the present exemplary embodiment.

From the graph, it was found that the idle rotation time of the photoreceptor drum necessary for removing the abnormal image with a void approximately linearly increases until the accumulated travel distance of the photoreceptor drum 1 reaches 140 km and thereafter enters into a saturation state.

Actually, based on the correlation between the accumulated travel distance of the photoreceptor drum 1 and the necessary idle rotation time specified by the graph, the idle rotation time suitable for the accumulated travel distance of the photoreceptor drum 1 is decided. The refresh process at the time of job interruption is performed during the idle rotation time, and so the occurrence of the abnormal image with a void can be almost completely removed. According to the present exemplary embodiment, the idle rotation time according to the accumulated travel distance of the photoreceptor drum 1 is decided by using a table shown in Table 2.

TABLE 2

| Accumulated travel distance [km] | Idle rotation time [s] |
|---|---|
| 0 | 6.0 |
| 20 | 9.4 |
| 40 | 12.9 |
| 60 | 16.3 |
| 80 | 19.7 |
| 100 | 23.1 |
| 120 | 26.6 |
| >140 | 30.0 |

Further, since the occurrence of the abnormal image with avoid greatly depends on the apparatus environment in which the present printer is disposed, the interruption time (the refresh process) of the continuous image forming job is preferably decided in view of the apparatus environment.

Figure 6:
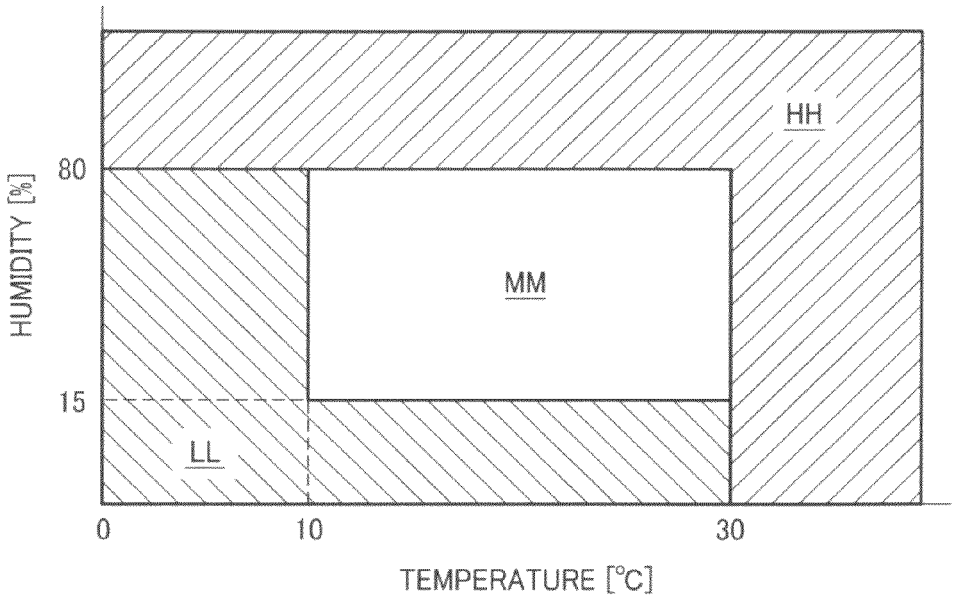
FIG. 6 is an explanatory view for explaining discrimination of a low-temperature low-humidity (LL) environment, a medium-temperature medium-humidity (MM) environment, and a high-temperature high-humidity (HH) environment.

FIG. 6 is an explanation view for explaining categories of a low-temperature low-humidity (LL) environment, a medium-temperature medium-humidity (MM) environment, and a high-temperature high-humidity (HH) environment.

Figure 7:
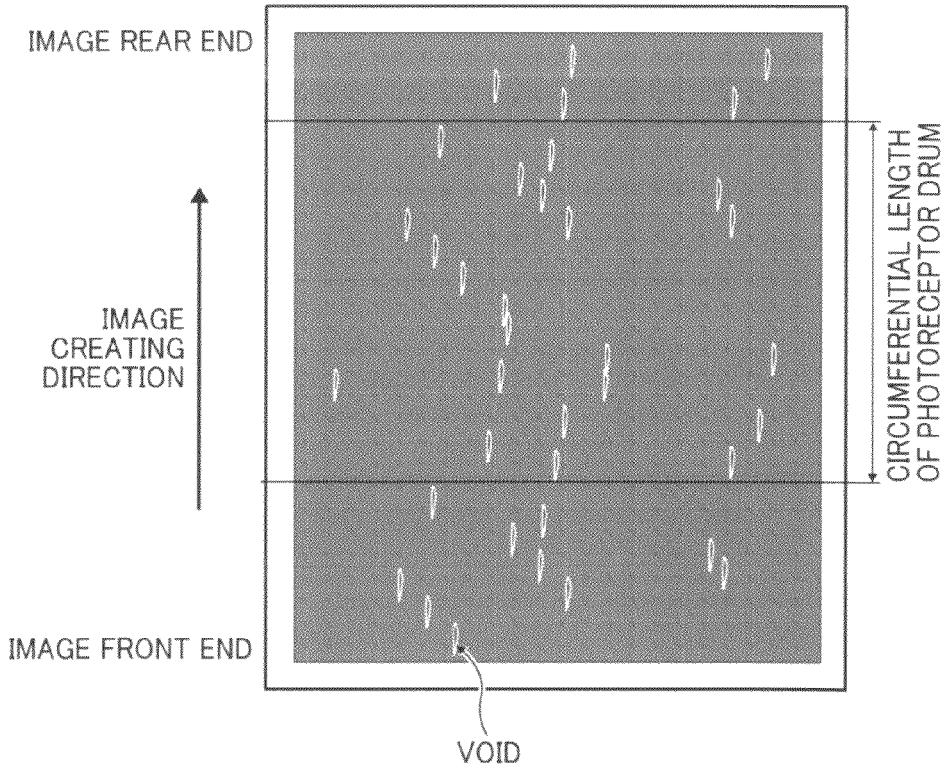
FIG. 7 illustrates an example of an abnormal image with a void that is produced in the LL environment.

FIG. 7 illustrates an example of an image in which the abnormal image with a void occurs in the LL environment.

Figure 8:
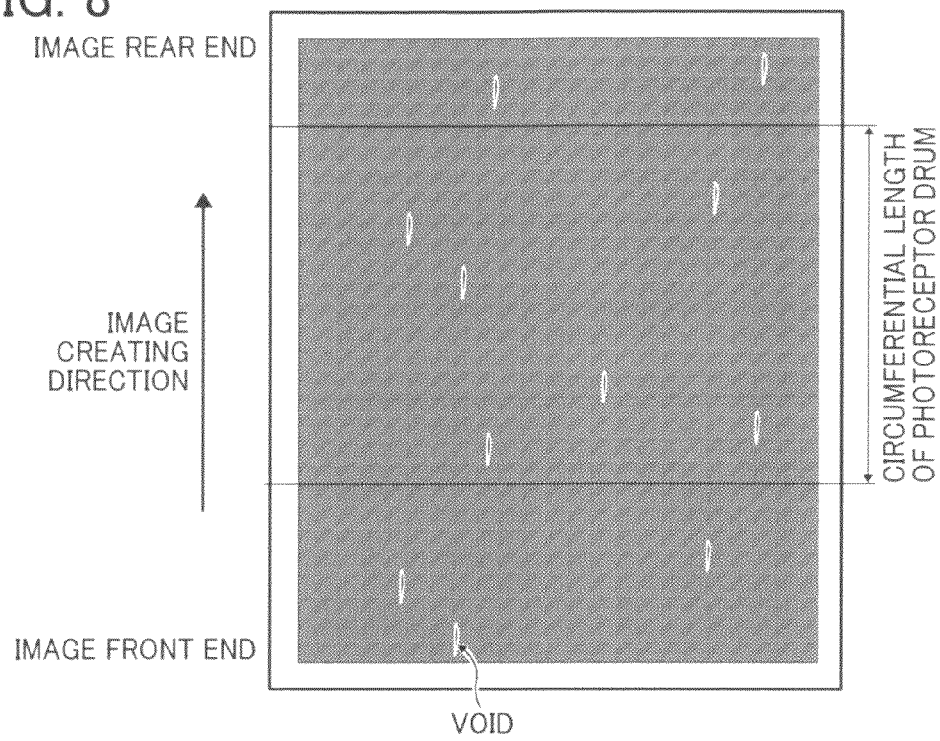
FIG. 8 illustrates an example of an abnormal image with a void that is produced in the HH environment.

FIG. 8 illustrates an example of an image in which the abnormal image with a void occurs in the HH environment.

Figure 9:
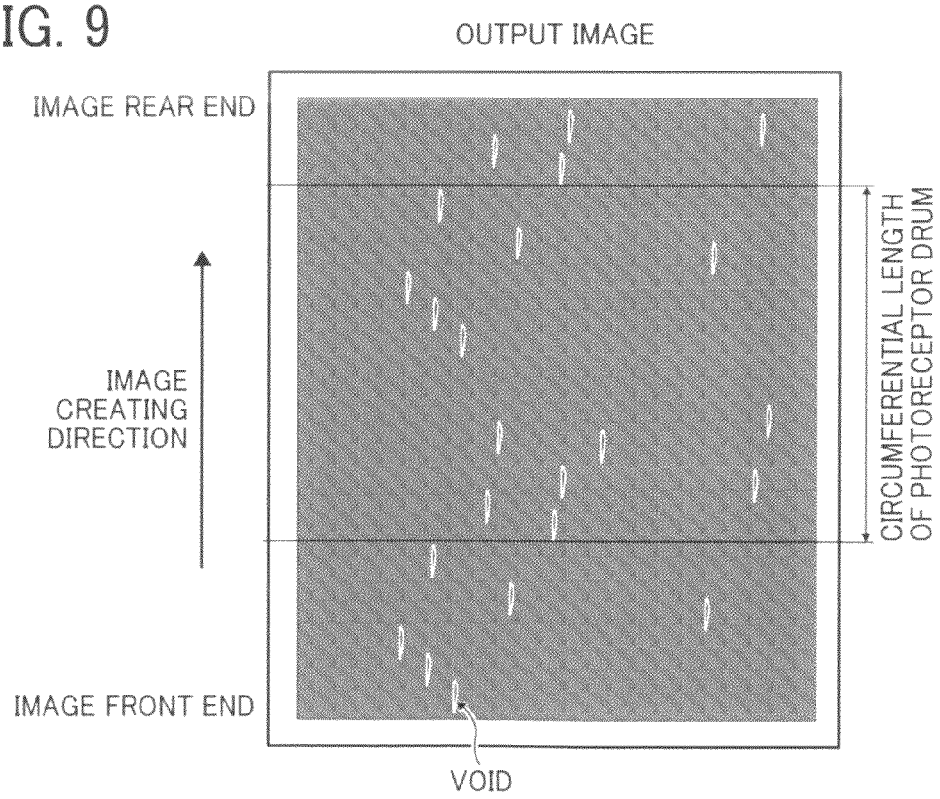
FIG. 9 illustrates an example of an abnormal image with a void that is produced in the MM environment.

It was found that the number of occurrence of the abnormal image with a void in the HH environment is 0.8 times an image example of the MM environment illustrated in FIG. 9, and the number of occurrence of the abnormal image with a void in the LL environment is 1.2 times that in the MM environment. The image examples illustrated in FIGS. 7 to 9 were created under the same condition except that the apparatus environment is different.

As a result of measuring the number of sheets passed until the abnormal image with a void occurs, it was understood that the abnormal image with a void occurs in the HH environment at the number of passed sheets that is 1.2 times that in the MM environment, and in the LL environment at the number of passed sheets that is 0.8 times that in the MM environment. Thus, according to the present exemplary embodiment, a correction coefficient (an environment correction coefficient) of the idle rotation in each environment was decided as in Table 3 below.

TABLE 3

| Environment category | Idle rotation time correction coefficient |
|---|---|
| LL | 0.8 |
| MM | 1.0 |
| HH | 1.2 |

According to the present exemplary embodiment, the temperature and humidity are detected by a temperature humidity sensor as an apparatus environment detection unit disposed in the present printer, and the apparatus environment is specified based on the detection result. The environment correction coefficient corresponding to the apparatus environment is decided based on the data table of Table 3. A value obtained by multiplying the void index value of Table 1 that is the data table of the MM environment by the decided environment correction coefficient is decided as a new void index value. Using this, the void index value is accumulated and counted, and when the accumulated count value reaches 100, the continuous image forming job stops, and the idle rotation operation of the photoreceptor drum is performed. By performing such control, the occurrence of the abnormal image with a void can be stably prevented at any apparatus environment.

Further, the void index value of each environment to which the environment correction coefficient is applied is previously obtained and stored as a data table shown in Table 4. The void index value corresponding to each environment can be more simply decided using the data table.

TABLE 4

| | Void index value | | |
|---|---|---|---|
| Image area ratio [%] | MM environment | LL environment | HH environment |
| <5 | 0.0143 | 0.0171 | 0.0114 |
| 10 | 0,0333 | 0.0400 | 0.0267 |
| 20 | 0.0833 | 0.1000 | 0.0667 |
| 30 | 0.1000 | 0.1200 | 0.0800 |
| 40 | 0.1250 | 0.1500 | 0.1000 |
| 50 | 0.2222 | 0.2667 | 0.1778 |
| 60 | 0.2857 | 0.3429 | 0.2286 |
| 70 | 0.3333 | 0.4000 | 0.2667 |
| 80 | 0.5000 | 0.6000 | 0.4000 |
| 90 | 0.6250 | 0.7500 | 0.5000 |
| 100 | 1.0000 | 1.2000 | 0.8000 |

As the accumulated travel distance of the photoreceptor drum 1 increases, the substance causing filming that is formed until a abnormal image with a void is generated is further difficult to be removed, and the abnormal image with a void is difficult to be removed. For this reason, according to the present exemplary embodiment, as described above, as the accumulated travel distance of the photoreceptor drum 1 increases, control of increasing the idle rotation time is performed. However, it could be understood that there is a case in which the substance causing filming cannot be effectively removed only by simply increasing the idle rotation time according to a use environment of the present printer or a kind (an image area ratio) of the image formed by the present printer. As a result of conducting studies, the inventor of the present invention found out that in this case, when the refresh process is performed by idly rotating, the photoreceptor drum 1, it is effective in removing the substance causing filming to perform the idle rotation in a reverse direction at appropriate timing. It is considered that the reason is because the adhered substances such as the toner or the sheet powder clogged between the cleaning blade 41 and the surface of the photoreceptor drum 1 are easily separated therefrom at the time of the reverse rotation operation, and so the cleaning performance (the rubbing performing) by the cleaning blade 41 can be restored.

Therefore, according the present exemplary embodiment, the idle rotation operation of the reverse direction is performed at a rate of once of ten times in which the photoreceptor drum 1 idly rotates. As a result, even though the accumulated travel distance of the photoreceptor drum 1 increases, the abnormal image with a void can be stably removed. The frequency of the idle rotation operation of the reverse direction is a numerical value appropriately changed because it depends on a diameter or a material of the photoreceptor drum or the structure of the cleaning member.

Further, even in the case in which a large amount of the images having the image area ratio 100% is continuously formed, the occurrence of the abnormal image with a void can be initially prevented by appropriately performing the idle rotation operation and performing the refresh process as in the present exemplary embodiment, but there was a case in which the abnormal image with a void occurred with time. As a result of conducting the verification experiment, the inventor of the present invention found out that the reason is because a large amount of toner is adhered to the lubricant coating brush 22, and the lubricant coating efficiency gets worse, so that the surface frictional coefficient of the photoreceptor drum 1 increases.

Therefore, according to the present exemplary embodiment, the bias power source is connected to the lubricant coating brush 22, and the bias having the same polarity as the normal polarity of the toner is applied to the lubricant coating brush 22 during the idle rotation operation of the photoreceptor drum 1. As a result, the toner is difficult to adhere to the lubricant coating brush 22. The lubricant coating performance is stably maintained with time, and the occurrence of the abnormal image with a void can be prevented with time even in the adverse use environment in which a large amount of images having the image area ratio 100% are continuously formed and the abnormal image with a void may occur.

Further, in the present exemplary embodiment, since the toner images of the respective colors formed on the four photoreceptor drums are sequentially primary transferred on the intermediate transfer belt 60 in the superimposed manner, a phenomenon that the toner of each color primary transferred at the upstream side is reversely transferred to the photoreceptor drum at the downstream side of the endless moving direction of the intermediate transfer belt 60 at the time of primary transfer occurs. For this reason, even if of the toner image having exactly the same image area ratio is formed on all of the photoreceptor drums, as the position of the photoreceptor drum is close to the downstream side of the endless moving direction of the intermediate transfer belt, an amount of unnecessary toner (residual transfer toner or reverse transferred toner) that should be removed by the cleaning blade 41 increases.

Therefore, according to the present exemplary embodiment, a Y value, a C value, an M value, and a K value that are the image area ratios (%) in which the reverse transfer is considered are individually computed for each of the photoreceptor drums as in Equations (2) to (5) and used as the image area ratios (%) of the photoreceptor drums. In Equations (2) to (5), "$Y_0$," "$C_0$," "$M_0$," and "$K_0$" are the image area ratios in which the reverse transfer is not considered. "p" is a reverse transfer rate.

$$Y\text{ value}=Y_0 \tag{2}$$

$$C\text{ value}=C_0+Y_0\times p \tag{3}$$

$$M\text{ value}=M_0+(Y_0+C_0)\times p \tag{4}$$

$$K\text{ value}=K_0+(Y_0+C_0+M_0)\times p \tag{5}$$

If the reverse transfer is considered, compared to the case in which the reverse transfer is not considered, since the image area ratio used for computing the void index value is different, the void index value is different. Specially, if $K_0$=50%, $Y_0$=100%, $C_0$=100%, $M_0$=100%, and p=5%, the K value is $K_0+(Y_0+C_0+M_0)\times p=50+(100+100+100)\times 0.05=65\%$. Thus, when the reverse transfer is not considered, it is 0.2222 as in Table 1, whereas when the reverse transfer is considered, it is 0.2857.

In the case of using individual void index values for each of the photoreceptor drums, the interruption time at which the idle rotation operation is performed in each of photoreceptor drums is different from each other. If the interruption time at which the idle rotation operation is performed in each of photoreceptor drums is different, downtime (time in which the image formation operation is not performed) caused by the idle rotation operation during the continuous image forming job increases, so that the productivity of the image deteriorates. Therefore, according to the present exemplary embodiment, at timing in which the accumulated count value of the void index value reaches 100 in any one of the four photoreceptor drums, all of the photoreceptor drums idly rotate, and the refresh process is performed. After the refresh process, the accumulated count values of the void index values of all of the photoreceptor drums are reset to zero. Therefore, an increase in downtime caused by the idle rotation operation during the continuous image forming job can be suppressed. The idle rotation time may be set according to the accumulated travel distance of each of the photoreceptor drums.

Next, a preferred example of the toner that can be used in the present embodiment will be explained.

As combination components of the toner material, a binder resin and/or a binder resin precursor is used. The binder resin is a modified polyester comprising at least ester bonds, and bond units other than the ester bond, and the binder resin precursor is a resin precursor that can produce the above-described modified polyester. This binder resin precursor is preferably those containing a compound that has an active hydrogen group, and a polyester that has a functional group that is reactive to the active hydrogen group of the compound. For example, when the polyester that has an isocyanate group [the polyester prepolymer (A)] is used as those containing a polyester that has a functional group that is reactive to the active hydrogen group, the polyester prepolymer (A) can be manufactured with a method as described below.

A polyol (1) and a polycarboxylic acid (2) are heated to 150° C. to 280° C. in the presence of a commonly known esterification catalyst such as tetrabutoxy titanate, dibutyltin oxide, etc. Pressure is reduced if necessary, and water generated during the reaction is distilled off to obtain a polyester that has a hydroxyl group.

Then, the polyester that has a hydroxyl group is caused to react with polyisocyanate (3) at 40° C. to 140° C. to obtain a polyester prepolymer (A) that has an isocyanate group (briefly called the "prepolymer (A)").

Further, the polyester prepolymer (A) is caused to react with the amines (B), which is a compound that has an active hydrogen group, at 0° C. to 140° C. to obtain a polyester that is modified with an urea bond.

Examples of the polyol (1) include alkylene glycol (ethylene glycol, 1,2-propylene glycol, 1,3-propylene glycol, 1,4-butanediol, 1,6-hexanediol, etc.); alkylene ether glycol (diethylene glycol, triethylene glycol, dipropylene glycol, polyethylene glycol, polypropylene glycol, polytetramethylene ether glycol, etc.); alicyclic diol (1,4-cyclohexane dimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the above-described alicyclic diol; alkylene oxide (ethylene oxide, propylene oxide, butylene oxide, etc.) adducts of the above-described bisphenols, etc., which may be used in a combination of two or more kinds. Among them, alkylene oxide adducts of alkylene glycols having 2 to 12 carbon atoms and bisphenols (for example, an adduct of bisphenol A and 2 moles of ethylene oxide, an adduct of bisphenol A and 2 moles of propylene oxide, an adduct of bisphenol A and 3 moles of propylene oxide, etc.) are preferable.

Further, examples of the trihydric or higher hydric polyol include polyhydric aliphatic alcohol (glycerin, trimethylol ethane, trimethylol propane, pentaerythritol, sorbitol, etc.); trihydric or higher polyphenols (phenol novolac, cresol novolac, etc.); alkylene oxide adducts of the trihydric or higher hydric polyphenols, etc., which may be used in a combination of two or more kinds.

Examples of the polycarboxylic acid (2) include alkylene dicarboxylic acids (succinic acid, adipic acid, sebacic acid, etc.), alkenylene dicarboxylic acids (maleic acid, fumaric acid, etc.), and aromatic dicarboxylic acids (terephthalic acid, isophthalic acid, naphthalene dicarboxylic acid, etc.), which may be used in a combination of two or more kinds. Among them, the polycarboxylic acid (2) is preferably alkenylene dicarboxylic acids having 4 to 20 carbon atoms and aromatic dicarboxylic acids having 8 to 20 carbon atoms.

Examples of tricarboxylic or higher polycarboxylic acids include aromatic polycarboxylic acids having 9 to 20 carbon atoms (trimellitic acid, pyromellitic acid, etc.), which may be used in a combination of two or more kinds.

Further, anhydride or lower alkyl ester (methyl ester, ethyl ester, isopropyl ester, etc.) of polycarboxylic acid may be used instead of the polycarboxylic acid.

Examples of the polyisocyanate (3) include those represented as the isocyanate agent described earlier.

Examples of the amines (B) include those represented as the amines described earlier.

When causing the polyester to react with polyisocyanate (3) and when causing (A) to react with (B), a solvent may also be used if necessary.

Examples of the solvents that may be used include aromatic solvents (toluene, xylene, etc.), ketones (acetone, methyl ethyl ketone, methyl isobutyl ketone, etc.), esters (ethyl acetate, etc.), amides (dimethyl formamide, dimethyl acetoamide, etc.), and ethers (tetrahydrofuran, etc.) that are inactive with respect to the isocyanates (3).

On the other hand, when unmodified polyester [unmodified polyester (ii)] is used in a combination, the unmodified polyester (ii) is manufactured in the same method as that of the polyester that has a hydroxy group described earlier, which is dissolved in the solution after completion of the reaction (i) described earlier, and mixed.

Emulsification or Dispersion in Aqueous Medium (Aqueous Phase) of Toner Material Solution (Oil Phase)

The aqueous medium (aqueous phase) described earlier that is used in the present embodiment may be water alone, or a solvent that is mixable with water may be used in combination.

Examples of the mixable solvent include alcohols (methanol, isopropanol, ethylene glycol, etc.), dimethyl formamide, tetrahydrofuran, cellosolves (methyl cellosolve, etc.), and lower ketones (acetone, methyl ethyl ketone, etc.).

Further, the aqueous medium (aqueous phase) may contain a dispersing agent such as a surfactant and polymeric protecting colloids as described below.

As a binder resin precursor at the time of forming the parent particles, when a polyester that has an isocyanate group [polyester prepolymer (A)] and amines (B) are used, the polyester prepolymer (A) and the amines (B) may be caused to react with each other in an aqueous medium to form a modified polyester [urea-modified polyester: [modified polyester (i)]], or a modified polyester [urea-modified polyester: [modified polyester (i)]] is previously manufactured by reacting the polyester prepolymer (A) with the amines (B).

An example of the method of stably forming the urea-modified polyester [modified polyester (i)], or the dispersion body comprising the polyester prepolymer (A) and the amines (B) in the aqueous medium, is a method of adding the modified polyester (i), or the prepolymer (A) and the amines (B), and other composition components of a toner material (raw material) comprising a binder resin (crystalline polyester, etc.) and a mold releasing agent to an aqueous medium, and dispersing the mixture by shearing force, etc.

The polyester prepolymer (A) and the other toner composition components (hereinafter, referred to as the "toner raw material"), i.e., the colorant (or the colorant master batch), the mold releasing agent, the crystalline polyester, the unmodified polyester, the electric charge controller, etc., may be mixed at the time of forming the dispersion body in the aqueous medium, but preferably, the toner raw materials are previously mixed, and then the mixture is added to the aqueous medium and is dispersed. Further, in the present embodiment, the toner raw materials such as the colorant and the electric charge controller are not necessarily mixed at the time of forming particles in the aqueous medium, but may be added after forming the particles. For example, particles containing no colorant may be formed, and then a colorant may be added with a known dyeing method.

The dispersion method is not particularly limited, and commonly known methods such as a low-speed shearing method, a high-speed shearing method, a friction method, a high-pressure jet method and an ultrasonic method may be adopted. Among them, the high speed shearing method is preferable for ensuring a particle diameter of 2 to 20 μm of the dispersion body. When a dispersion device of a high-speed shearing method is used, the revolution number is not particularly limited, but is normally 1,000 to 30,000 revolutions per minute (rpm), and preferably 5,000 to 20,000 rpm. The dispersion time is not particularly limited, but is normally 0.1 to 5 minutes when a batch method is used. The dispersion temperature is normally 0° to 150° C. (under pressure), and preferably 40° to 98° C. Higher temperature is preferable in point of low viscosity and easy dispersion of the dispersion body comprising the urea-modified polyester [modified polyester (i)] and the polyester prepolymer (A).

A usage amount of the aqueous medium is normally 50 to 2,000 parts by weight, and preferably 100 to 1,000 parts by weight with respect to 100 parts by weight of the toner material (toner composition) comprising the modified polyester (i) or the polyester prepolymer (A) and the amines (B). If the usage amount of the aqueous medium becomes less than 50 parts by weight, the dispersed state of the toner solution deteriorates and toner particles of a predetermined particle diameter cannot be obtained. If the usage amount of the aqueous medium exceeds 20000 parts by weight, toner manufacturing is not economical.

Further, a dispersing agent may be also used if necessary as described above. Use of the dispersing agent is preferable in point of a sharp distribution of the particle diameter and stable dispersion.

As described above, the process of synthesizing the urea-modified polyester [the modified polyester (i)] from the polyester prepolymer (A) and the amines (B), may be conducted by previously adding the amines (B) to cause it to react before dispersing the toner material solution (oil phase) comprising (A) in the aqueous medium, or conducted by dispersing the toner material solution (oil phase) comprising (A) in the aqueous medium, and then adding the amines (B) to cause it to react (reaction from the particle interface). In this case, it is also possible that the urea-modified polyester is preferentially produced on the surface of parent particles to be formed, and a concentration gradient is set up within the particles.

As a dispersing agent for emulsifying and dispersing the toner material solution (oily phase: oil phase), in which the toner material (toner composition) is dispersed as described above, in a liquid containing water (aqueous medium: aqueous phase), a surfactant may be used.

Examples of the surfactant include anionic surfactants such as alkylbenzene sulfonate, α-olefin sulfonate and ester phosphate; cationic surfactants of amine salt type, e.g., alkyl amine salts, amino alcohol fatty acid derivatives, polyamine fatty acid derivatives, imidazoline, and quaternary ammonium salt type, e.g., alkyl trimethyl ammonium salt, dialkyl dimethyl ammonium salt, alkyl dimethyl benzyl ammonium salt, pyridinium salt, alkyl isoquinolium salt and chlorobenzetonium; nonionic surfactants such as fatty acid amide derivatives and polyhydric alcohol derivatives; and zwitterionic surfactants such as alanine, dodecyl di(aminoethyl) glycine, di(octylaminoethyl) glycine and N-alkyl-N,N-dimethyl ammonium betaine.

Using a surfactant that has a fluoroalkyl group enables to enhance the effect of the surfactant with an extremely small amount of the surfactant. Examples of preferably used anionic surfactants that have a fluoroalkyl group include fluoroalkyl carboxylic acids having 2 to 10 carbon atoms and metal salts thereof, perfluorooctane sulfonyl disodium glutamate, 3-(ω-fluoroalkyl (C6 to C11) oxy)-1-alkyl (C3 to C4) sodium sulfonate, 3-(ω-fluoroalkanoyl (C6 to C8)-N-ethylamino)-1-propane sodium sulfonate, fluoroalkyl (C11 to C20) carboxylic acid and metal salts thereof, perfluoroalkyl carboxylic acid (C7 to C13) and metal salts thereof, perfluoroalkyl (C4 to C12) sulfonic acid and metal salts thereof, perfluorooctane sulfonic acid diethanol amide, N-propyl-N-(2-hydroxyethyl) perfluorooctane sulfonamide, perfluoroalkyl (C6 to C10) sulfonamide propyltrimethyl ammonium salt, perfluoroalkyl (C6 to C10)-N-ethylsulfonyl glycine salt, and monoperfluoroalkyl (C6 to C16) ethyl phosphoric acid ester.

Examples of product names are Saflon S-111, S-112, S-113 (manufactured by Asahi Glass Company), Flolard FC-93, FC-95, FC-98, FC-129 (manufactured by Sumitomo 3M Company), Unidine DS-101, DS-102 (manufactured by Daikin Industries Company), Megafac F-110, F-120, F-113, F-191, F-812, F-833 (manufactured by Dai Nihon Ink Company), Ektop EF-102, 103, 104, 105, 112, 123A, 123B, 306A, 501, 201, 204 (manufactured by Tohkem Products Company), and Futargent F-100, F-150 (manufactured by Neos Company).

Examples of the cationic surfactant include aliphatic primary and secondary or secondary amino acids that have a fluoroalkyl group, aliphatic quaternary ammonium salts such as perfluoroalkyl (C6 to C10) sulfonamide propyl trimethyl ammonium salt, benzalkonium salt, benzetonium chloride, pyridinium salt, and imidazolium salt. Examples of product names include Saflon S-121 (manufactured by Asahi Glass Company), Flolard FC-135 (manufactured by Sumitomo 3M Company), Unidine DS-202 (manufactured by Daikin Industries Company), Megafac F-150, F-824 (manufactured by Dai Nihon Ink Company), Ektop EF-132 (manufactured by Tohkem Products Company), and Futargent F-300 (manufactured by Neos Company), etc.

Further, as dispersing agents of water-poorly soluble inorganic compounds, tricalcium phosphate, calcium carbonate, titanium oxide, colloidal silica, hydroxyapatite, etc. may also be used.

By using polymeric protecting colloids, the dispersion droplets may also be stabilized. Examples of the polymeric protecting colloids include acids such as acrylic acid, methacrylic acid, α-cyanoacrylic acid, α-cyanomethacrylic acid, itaconic acid, crotonic acid, fumaric acid, maleic acid and maleic anhydride; (meth)acrylic monomers that have a hydroxyl group, for example, acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylic acid ester, diethylene glycol monomethacrylic acid ester, glycerin monoacrylic acid ester, glycerin monomethacrylic acid ester, N-methylol acrylic amide, N-methylol methacrylic amide, etc.; or vinyl alcohols or ethers with vinyl alcohols, for example, vinyl methyl ether, vinyl ethyl ether, vinyl propyl ether, etc.; esters of a vinyl alcohol and a compound having a carboxyl group, for example, vinyl acetate, vinyl propionate, vinyl butyrate, etc.; acrylic amide, methacrylic amide, diacetone acrylic amide or methylol compounds thereof; acid chlorides such as acryloyl chloride and methacroyl chloride; nitrogen-containing compounds or heterocyclic homopolymers or copolymers thereof such as vinyl pyridine, vinyl pyrrolidone, vinyl imidazole and ethylene imine; or polyoxyethylenes such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester and polyoxyethylene nonylphenyl ester; and celluloses such as methyl cellulose, hydroxyethyl cellulose, hydroxypropyl cellulose, etc.

Further, if a chemical such as a calcium phosphate, which is soluble in acid and alkali, is used as a dispersion stabilizer, the calcium phosphate, is dissolved using an acid such as hydrochloric acid and the resulting solution is washed with water to remove the calcium phosphate from the toner particles. Further, the calcium phosphate may also be removed using a procedure such as enzymatic breakdown.

When the dispersing agent is used, the dispersing agent may remain on the surface of the toner particles, but preferably is washed and removed after the elongation reaction and/or crosslinking reaction in view of the electrostatic charge of the toner.

Further, a solvent in which the modified polyester (i) or the prepolymer (A) is soluble, may be used in order to lower the viscosity of the toner material solution (oil phase) in which the toner material (toner composition) is dissolved or dispersed. Use of such solvent is preferable in point of sharp distribution of the particle diameter. A volatile solvent having a boiling point of less than 100° C. is preferably used in point of easy removal of the solvent after formation of the parent toner particles.

As such solvent, toluene, xylene, benzene, tetrachlorocarbon, chloromethylene, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. may be used alone or as a combination of two or more chemicals mentioned earlier. Especially, aromatic solvents such as toluene and xylene, and halogenated hydrocarbons such as chloromethylene, 1,2-dichloroethane, chloroform and tetrachlorocarbon are preferable. A usage amount of the solvent is normally 0 to 300 parts by weight, preferably 0 to 100 parts by weight, and further preferably 25 to 70 parts by weight with respect to 100 parts by weight of the polyester prepolymer (A). When the solvent is used, the solvent is removed by warming under ordinary pressure or under reduced pressure after the elongation reaction and/or crosslinking reaction.

The reaction time of the elongation reaction and/or crosslinking reaction is selected based on a reactivity of an isocyanate group structure contained in the polyester prepolymer (A) with the amines (B), but is normally 10 minutes to 40 hours, and preferably 2 to 24 hours. The reaction temperature is normally 0° C. to 150° C. and preferably 40° C. to 98° C. A commonly known catalyst may be used if necessary. To be specific, a catalyst such as dibutyltin laurate or dioctyltin laurate may be used.

Solvent Removal

In order to remove the organic solvent from the emulsion dispersion body that is obtained by emulsifying or dispersing the toner material solution (oil phase) in the aqueous medium (aqueous phase), it may be preferable to use a method of slowly warming the whole system, and completely evaporating and removing the organic solvent in the liquid droplets. Alternatively, it is also possible to use a method of spraying the emulsion dispersion body in a drying atmosphere, and completely removing non-water-soluble organic solvent in the liquid droplets to form particles that become parent particles and also evaporate and remove the aqueous dispersing agent.

As the drying atmosphere in which the emulsion dispersion body is sprayed, air, nitrogen, carbon dioxide, gas heated by combustion gas, etc., particularly various flow currents that are heated to a temperature higher than the boiling point of the maximum boiling point solvent that is used, are generally used. Intended quality is sufficiently obtained with short time treatment by a spray dryer, a belt dryer, a rotary kiln, or the like.

Washing and Drying

When the particle size distribution at the time of emulsion dispersion is broad, and washing and drying treatments are conducted with keeping the particle size distribution, the particles can be classified by a desired particle size distribution to arrange the particle size distribution.

Classification

A classification procedure allows elimination of the part of unwanted size particles by a decanter, centrifugation, etc. in the solution. Needless to say, the classification procedure may be conducted after acquiring powders by the drying, but preferably conducted in the liquid state in view of the efficiency. Classified unwanted size particles, or coarse particles are returned again to the kneading process to be used in particle formation. At this time, it makes no problem that the particles or the coarse particles are in a wet state.

The used dispersing agent is preferably eliminated from the obtained dispersion solution as much as possible, which is preferably conducted simultaneously with the classification procedure as described earlier.

The obtained powders (parent particles) after drying are mixed if necessary with heterologous particles such as particles of a mold releasing agent, particles of an electrostatic charge controller, particles of a fluidizer and particles of a colorant, and mechanical impact power is applied to the mixed powders to fix and fuse the particles on the surface, whereby to obtain a toner (toner that has parent particles) that is constituted by parent particles. By application of the mechanical impact power, it is possible to prevent the heterologous from being detached from the surface of the obtained toner that has parent particles (complex particles).

As specific means of applying the mechanical impact power, there are a method of applying impact power to a mixture by blades rotating at high speed; a method of putting a mixture into high-speed flow current, accelerating and causing the particles to collide with each other or causing complexed particles to collide with an appropriate crash plate, etc.

Examples of the apparatus include an apparatus that is modified from Ongmill (manufactured by Hosokawa Micron Inc) or I-type mill (manufactured by Nippon Pneumatic Mfg. Co., Ltd.) to have lowered crushing air pressure, a hybridization system (manufactured by Nara Machinery Co., Ltd.), Kryptron system (manufactured by Kawasaki Heavy Industries, Ltd.), and automatic mortar.

Next, examples of the toner that can be used in the present embodiment will be explained. However, a toner that can be applied to the present invention is not limited to these examples. The term "parts" below indicates parts by weight.

First of all, materials, etc. that are necessary for obtaining the toners of Examples were manufactured as described below.

Manufacture Example 1

Preparation of Organic Particle Emulsion

In a reactor equipped with a stirring rod and a thermometer, placed were 700 parts of water, 12 parts of sodium salt of methacrylic acid-ethyleneoxide adduct sulfate ester (trade name: ELEMINOL RS-30, manufactured by Sanyo Chemical Industries, Ltd.), 140 parts of styrene, 140 parts of methacrylic acid, and 1.5 part of ammonium persulfate. Then, the mixture was stirred at 450 revolutions per minute (rpm) for 20 minutes to obtain a white emulsion. The emulsion was heated to an inner temperature of 75° C. and allowed to react for 5 hours. The reaction mixture was further treated with 35 parts of a 1% aqueous solution of ammonium persulfate, and aged at 75° C. for 5 hours, to obtain an aqueous dispersion (Particle Dispersion 1) of a vinyl resin (copolymer of styrene-methacrylic acid-sodium sulfate ester of methacrylic acid-ethylene oxide adduct).

The Particle Dispersion 1 had a volume-average particle diameter of 0.30 μm as determined using LA-920. A portion of the Particle Dispersion 1 was dried to isolate a resin component. The resin component had a glass transition point (Tg) of 155° C.

Manufacture Example 2

Preparation of Aqueous Phase

A white emulsion (Aqueous Phase 1) was prepared by blending and stirring 1,000 parts of water, 85 parts of the Particle Dispersion 1, 40 parts of a 50% aqueous solution of sodium dodecyl diphenyl ether disulfonate (trade name: ELEMINOL MON-7, manufactured by Sanyo Chemical Industries, Ltd.), and 95 parts of ethyl acetate.

Manufacture Example 3

Preparation of Low Molecular Weight Polyester (Polyester that has a Hydroxy Group)

In a reactor equipped with a condenser, a stirrer and a nitrogen gas feed tube, placed were 235 parts of ethylene oxide (2 moles) adduct of bisphenol A, 535 parts of propylene oxide (3 moles) adduct of bisphenol A, 215 parts of terephthalic acid, 50 parts of adipic acid and 3 parts of dibutyltin oxide. The mixture was allowed to react at 240° C. for 10 hours under ordinary pressure and further at a reduced pressure of from 10 mmHg to 20 mmHg for 6 hours. Then, 45 parts of trimellitic anhydride were placed in a reactor, and the mixture was allowed to react at 185° C. for 3 hours under ordinary pressure, to obtain low molecular weight polyester 1. The low molecular weight polyester 1 had a number-average molecular weight of 2,800, a weight-average molecular weight of 7,100, a glass transition point (Tg) of 45° C., and an acid value of 22 mg KOH/g.

Manufacture Example 4

Preparation of Intermediate Polyester

In a reactor equipped with a condenser, a stirrer and a nitrogen gas feed tube, placed were 700 parts of ethylene oxide (2 mole) adduct of bisphenol A, 85 parts of propylene oxide (2 mole) adduct of bisphenol A, 300 parts of terephthalic acid, 25 parts of trimellitic anhydride, and 3 parts of dibutyltin oxide. The mixture was allowed to react at 240° C. for 10 hours under ordinary pressure and further for 6 hours under a reduced pressure of from 10 mmHg to 20 mmHg, to obtain intermediate polyester 1. The intermediate polyester 1 had a number-average molecular weight of 2,500, a weight-average molecular weight of 10,000, a glass transition point (Tg) of 58° C., an acid value of 0.5, and a hydroxyl group value of 52.

Preparation of Polyester Prepolymer that has an Isocyanate Group

Next, in a reactor equipped with a condenser, a stirrer and a nitrogen gas feed tube, placed were 400 parts of the intermediate polyester 1, 90 parts of isophorone diisocyanate, and 500 parts of ethyl acetate. The mixture was allowed to react at 110° C. for 6 hours to obtain prepolymer 1. The prepolymer 1 contains 1.67% by weight of free isocyanate.

Manufacture Example 5

Preparation of Crystalline Polyester

In a 5-liter 4-neck flask equipped with a nitrogen gas feed tube, a dewatering tube, a stirrer, and a thermocouple, placed were 28 moles of 1,4-butanediol, 24 moles of fumaric acid, 1.80 moles of trimellitic anhydride and 6.0 g of hydroquinone. Then, the mixture was allowed to react at 150° C. for 6 hours, and then at 200° C. for 1 hour, and further at 8.3 KPa for 1 hour, to obtain a crystalline polyester 1. The obtained crystalline polyester 1 had a melting point (DSC endothermic peak temperature) of 125° C., a number-average molecular weight of 800, a weight-average molecular weight of 3,000, an acid value of 26, and a hydroxyl group value of 30.

Manufacture Example 6

Preparation of Ketimine Compound

In a reactor equipped with a stirring rod and a thermometer, placed were 180 parts of isophorone diamine and 80 parts of methyl ethyl ketone. The mixture was then allowed to react at 50° C. for 6 hours to obtain ketimine compound 1. The amine value for the ketimine compound 1 was 420 mg KOH/g.

Manufacture Example 7

Preparation of Master Batch

MB 1,300 Parts of water, 550 parts of carbon black (trade name: Printex 35, manufactured by Degussa AG; DBP oil absorbance: 43 ml/100 mg; pH: 9.5), and 1,300 parts of a polyester were mixed using a HENSCHEL MIXER (manufactured by Mitsui Mining Co., Ltd). After kneading at 160° C. for 4 hour using a two roll mill, the mixture was cold-rolled and then pulverized in a pulverizer to obtain Master Batch 1.

Manufacture Example 8

Preparation of Oil Phase

Pigment Wax Dispersion Solution 1

In a reactor equipped with a stirring rod and a thermometer, placed were 400 parts of the low molecular weight polyester 1, 100 parts of microcrystalline wax (acid value: 0.1 KOH mg/g, melting point: 65° C., carbon number; 80, straight-chain hydrocarbon; 70 weight %), 20 parts of CCA (salicylic acid metal complex E-8 manufactured by Orient Chemical Industries), and 1,000 parts of ethyl acetate. The mixture was heated to and held at 80° C. for 8 hours while being stirred, and then cooled to 24° C. over 1 hour. The mixture was then treated with 480 parts of the Master Batch 1, and 550 parts of ethyl acetate with stirring for 1 hour to obtain material solution 1.

Next, the material solution 1 was placed in another vessel, and the carbon black and wax components therein were dispersed using a bead mill (trade name: ULTRAVISCO MILL, manufactured by Aimex Co., Ltd.) at a liquid feeding speed of 1 kg/hr, a disc circumferential speed of 6 m/sec, filled 80% by volume with 0.5 mm diameter zirconium beads. The procedure was repeated three times to disperse the carbon black and wax. Next, 1,000 parts of the 65% ethyl acetate solution of the low molecular weight polyester 1 were added to the dispersion, and the mixture was dispersed with one repetition of the above described procedures using the bead mill, to obtain pigment wax dispersion 1 having a solid content (130° C., 30 minutes) of 53%.

Manufacture Example 9

Preparation of Oil Phase

Pigment Wax Dispersion Solution 2

The same procedures were conducted as those of Manufacture Example 8 except that the microcrystalline wax used in the preparation of the pigment wax dispersion 1 of Manufacture Example 8 was changed to 55% by weight of a straight-chain hydrocarbon, to obtain the pigment wax dispersion 2.

Manufacture Example 10

Preparation of Oil Phase

Pigment Wax Dispersion Solution 3

The same procedures were conducted as those of Manufacture Example 8 except that the microcrystalline wax used in the preparation of the pigment wax dispersion 1 of Manufacture Example 8 was changed to that having 20 carbon atoms, to obtain the pigment wax dispersion 3.

Manufacture Example 11

Preparation of Crystalline Polyester Dispersion 110 g of the crystalline polyester 1 and 450 g of ethyl acetate were placed in a metal-made 2-L vessel. The mixture was heat-dissolved or heat-dispersed at 80° C., and then rapidly cooled in an ice water bath. To this, 500 mL of glass beads (3 mmϕ) were added, and the mixture was stirred with a batch-type sand mill apparatus (manufactured by Kanpe Hapio Co., Ltd.) for 10 hours, to obtain crystalline polyester dispersion 1 having a volume average particle diameter of 0.4 μm.

Example 1

Parent particles were obtained by processes of emulsification, solvent removal, washing and drying described below.

Emulsification

In a vessel were placed 700 parts of the pigment wax dispersion 1, 120 parts of the prepolymer 1, 80 parts of the crystalline polyester dispersion 1 and 5 parts of the ketimine compound 1, and the mixture was mixed at 6,000 rpm for 1 minute using a T.K. HOMO MIXER (manufactured by Tokushu Kika Kogyo Co., Ltd.). Next, the mixture was treated with 1,300 parts of the aqueous phase 1 by mixing at 13,000 rpm for 20 minutes using the T.K. HOMO MIXER, to obtain emulsified slurry 1.

Solvent Removal

The emulsified slurry 1 was placed in a vessel equipped with a stirrer and a thermometer, and heated at 30° C. for 10 hours to remove the solvent. Thereafter the resultant slurry was aged at 45° C. for 5 hours to obtain a dispersed slurry 1.

Washing and Drying

A total of 100 parts of the dispersed slurry 1 was filtered under a reduced pressure, and then washed by the following procedures.

(1) The filtered cake and 100 parts of deionized water were mixed in a T.K. HOMO MIXER at 12,000 rpm for 10 minutes, and the resultant mixture was filtered.

(2) The filtered cake prepared in (1) and 100 parts of a 10% aqueous solution of sodium hydroxide were mixed in a T.K. HOMO MIXER at 12,000 rpm for 30 minutes, and the resultant mixture was filtered under a reduced pressure.

(3) The filtered cake prepared in (2) and 100 parts of a 10% hydrochloric acid were mixed in a T.K. HOMO MIXER at 12,000 rpm for 10 minutes, and the resultant mixture was filtered.

(4) The filtered cake prepared in (3) and 300 parts of ion-exchanged water were mixed in a T.K. HOMO MIXER at 12,000 rpm for 10 minutes, and the resultant mixture was filtered. This washing procedure was further repeated twice to obtain filtered cake 1.

The filtered cake 1 was dried at 45° C. for 48 hours with a wind circulation drier, and sieved with an opening 75 μm mesh, to obtain parent particles 1.

Further, the dispersion diameter of the mold releasing agent in the parent particles 1 was 0.06 μm. The dispersion particle diameter of the crystalline polyester in the parent particles 1 was 0.2 μm or more and 3.0 μm or less as the long axis diameter. Further, the volume average particle diameter (Dv) of the parent particles 1 was 3.0 μm or more and 6.0 μm or less, and the ratio of the volume average particle diameter (Dv) to the number average particle diameter (Dn) (Dv/Dn) was 1.05 or more and 1.25 or less.

As described above, the printer according to the present exemplary embodiment is the image forming apparatus in which the latent image on the photoreceptor drum 1 as the latent image carrier rotationally driven by the input of the image formation job is developed by using the toner, the toner image obtained by the developing is finally transferred onto the recording sheet as the recording material, and the cleaning process of removing the unnecessary adhered substance on the photoreceptor drum 1 is performed by rubbing the rotationally driven photoreceptor drum 1 through the cleaning blade 41 as the cleaning member. The control unit of the present printer functions as a job interruption control unit. If an input of the continuous image forming job for continuously forming the image on a plurality of recording sheets is received, the control unit computes the accumulated count value (the abnormal image occurrence index value) of the void index value from based on the image area ratio of the toner image formed on the photoreceptor drum 1 by the continuous image forming job and the predetermined number of formed images (the number of passed sheets) in which the abnormal image with a void is generated when continuous image formation is performed at the image area ratio. The control unit decides a time in which the accumulated count value reaches a regulation value (100) as a time for interrupting the continuous image forming job. During the interruption period of the continuous image forming job, the cleaning process (the refresh process) is performed by performing the idle rotation in which the photoreceptor drum 1 rotates in a state in which the toner is not supplied to the photoreceptor drum 1 by the developing apparatus 5. Therefore, even in the environment in which the abnormal image with a void easily occurs such as the case of continuously forming the image having the high image area ratio, the refresh process is performed at appropriate timing that does not greatly deteriorate the productivity of the image, thereby preventing the occurrence of the abnormal image with a void.

Particularly, the toner according to the present exemplary embodiment is the polymerization toner containing microcrystalline wax, and more particularly, the toner made by the method of emulsifying and dispersing, in the aqueous medium (aqueous phase), the toner material solution (oil phase), in which the a toner material containing at least the binder resin and/or the binder resin precursor and a release agent is dissolved and dispersed in the organic solvent and thereafter forming the parent particles by the particles granulated by the solvent Removal (the colored particles). Preferably, the binder resin contains the modified polyester comprising at least ester bonds and bond units other than the ester bond, and the binder resin precursor contains the resin precursor that can produce the above-described modified polyester. In the case in which the binder resin and/or the binder resin precursor (that contains at least the modified polyester, the resin precursor that can produce the modified polyester, and crystalline polyester) and the mold releasing agent are contained as combination components of the toner material as described above, the toner can be made of the parent particles formed by dissolving or dispersing the combination components of the toner material in the organic solvent to make the toner material solution (oil phase), emulsifying or dispersing the aqueous phase in the aqueous medium (aqueous phase), and then granulating by the solvent Removal.

The effect of preventing the occurrence of the abnormal image with a void through the refresh process can increase by using preferably the polymerization toner made by the SPR method.

Further, according to the present exemplary embodiment, the control as a latent image carrier accumulated travel distance detecting unit for detecting the accumulated travel distance of the photoreceptor drum 1 accumulates and counts the rotation number of the photoreceptor 1 and decides the idle rotation time of the photoreceptor drum 1 based on the accumulated travel distance of the photoreceptor obtained from the detection result. Thus, it is possible to prevent the occurrence of the abnormal image with a void even at the elapsed time at which the abnormal image with a void easily occurs.

Further, according to the present exemplary embodiment, a temperature humidity sensor as an apparatus environment detecting unit for detecting an apparatus environment including at least one of the temperature and humidity is disposed. The interruption time of the continuous image forming job is decided in view of the detection result of the continuous image formation. Thus, the refresh process can be performed at the appropriate interruption time according to the apparatus environment, and thus the effects of stably preventing both the productivity decline and the occurrence of the abnormal image with a void can increase.

Further, according to the present exemplary embodiment, the photoreceptor drum 1 rotates in the direction reverse to the rotation direction during the image forming operation according to the predetermined reverse rotation condition (at a rate of one time of the idle rotations of ten times) when the photoreceptor drum 1 idly rotates. Thus, the cleaning performance (the rubbing performance) by the cleaning blade 41 can be restored, and the appropriate refresh process can be continuously performed.

Furthermore, according to the present exemplary embodiment, the lubricant coating apparatus 2 is disposed as a lubricant coating unit for coating the lubricant adhered to the lubricant coating brush 22 on the photoreceptor drum 1. When the photoreceptor drum 1 idly rotates during the interruption period of the continuous image formation job, the bias having the same polarity as the normal charging polarity of the toner is applied to the lubricant coating brush 22. As a result, the toner is hardly adhered to the lubricant coating brush 22, and the lubricant coating performance is stably maintained with time. Even in the adverse use environment in which a large amount of images having the image area ratio 100% are continuous formed and so the abnormal image with a void may occur, the occurrence of the abnormal image with a void can be prevented with time.

Further, the present of the present exemplary embodiment is a tandem type image forming apparatus in which the image in which the toner images formed on the four photoreceptor drums are superimposed is finally transferred onto the recording sheet. A time when any of the accumulated count values computed for each of the photoreceptor drums reaches the regulation value (100) is decided as the interruption time of the continuous image forming job. Thus, an increase in downtime caused by the idle rotation operation during the continuous image forming job can be suppressed.

According to the present invention, there is provided an image forming apparatus capable of suppressing an occurrence of an abnormal image with a void without allowing a decrease in productivity of, image production even in the cases in which images are formed under the conditions which abnormal images with a void are likely to be formed, such as the cases in which images with a high image area ratio are continuously formed and images with a low image area ratio are continuously formed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that develops a latent image on a rotationally driven latent image carrier by a developing unit using a toner when receiving an input of an image forming job, transfers a toner image thus obtained onto a recording material, and performs a cleaning process of removing an unnecessary substance adhering to the latent image carrier by rubbing the rotationally driven latent image carrier by a cleaning member, comprising:

a job interruption control unit that, when an input of a continuous image forming job for continuously forming an image on a plurality of recording materials is received, decides timing for interrupting the continuous image forming job based on an image area ratio of a toner image formed on the latent image carrier through the continuous image forming job and a predetermined number of images that are formed until a predetermined type of abnormal image is generated when the continuous image formation is performed with the image area ratio; and during an interruption period of the continuous image forming job, performs an idle rotation in which the latent image carrier rotates in a state in which the toner is not supplied to the latent image carrier by the developing unit to perform the cleaning process.

2. The image forming apparatus according to claim 1, wherein a polymerization toner containing microcrystalline wax is used as the toner.

3. The image forming apparatus according to claim 1, further comprising:

a latent image carrier accumulated travel distance detecting unit for detecting an accumulated travel distance of the latent image carrier, wherein the job interruption control unit decides an idle rotation time of the latent image carrier during the interruption period based on the detection result of the latent image carrier accumulated travel distance detecting unit.

4. The image forming apparatus according to claim 1, further comprising:

an apparatus environment detecting unit for detecting an apparatus environment including at least one of temperature and humidity, wherein the job interruption control unit decides the timing for interrupting the continuous image forming job in view of the detection result of the apparatus environment detecting unit.

5. The image forming apparatus according to claim 1, wherein the job interruption control unit rotates the latent image carrier in a direction reverse to a rotation direction during an image forming operation when idly rotating the latent image carrier according to a predetermined reverse rotation condition.

6. The image forming apparatus according to claim 1, further comprising:

a lubricant coating unit for coating a lubricant adhering to a lubricant coating brush on the latent image carrier, wherein the job interruption control unit applies a bias having the same polarity as a normal charging polarity of the toner to the lubricant coating brush when idly rotating the latent image carrier during the interruption period of the continuous image forming job.

7. The image forming apparatus according to claim 1, further comprising:

a structure of finally transferring an image in which toner images formed on the plurality of latent image carriers are superimposed on each other onto the recording material, wherein a control unit performs:

computing an abnormal image occurrence index value of each of the latent image carriers based on the image area ratio of the toner image that is formed on the latent image carrier through the continuous image forming job and the predetermined number of formed images that is formed until a predetermined type of abnormal image is generated when continuous image formation is performed with the image area ratio for each of the latent image carrier; and deciding the timing for interrupting the continuous image forming job based on the abnormal image occurrence index value that first reaches a regulation value among the computed abnormal image occurrence index values.

* * * * *